US005220705A

United States Patent [19]

Bushey

[11] Patent Number: 5,220,705

[45] Date of Patent: Jun. 22, 1993

[54] FURNITURE FLOOR GLIDE

[76] Inventor: Richard D. Bushey, 3521 16th Ave., Kenosha, Wis. 53140

[21] Appl. No.: 742,595

[22] Filed: Aug. 9, 1991

[51] Int. Cl.[5] ..... A47B 91/06

[52] U.S. Cl. ..... 16/42 R

[58] Field of Search ..... 16/42 R

[56] References Cited

U.S. PATENT DOCUMENTS

| | | | |
|---|---|---|---|
| 1,069,141 | 8/1913 | Jones . | |
| 1,982,138 | 11/1934 | Herold | 16/42 R |
| 2,317,080 | 4/1943 | Phillips | 45/137 |
| 2,717,410 | 9/1955 | Holloman | 16/42 R |
| 2,787,085 | 4/1957 | Auer | 45/137 |
| 2,996,753 | 8/1961 | Kramcsak, Jr. | 16/42 |
| 3,126,666 | 3/1964 | Petersen | 45/137 |
| 3,177,518 | 4/1965 | Bergstrom | 16/42 |
| 3,311,338 | 3/1967 | Culley | 248/205 |
| 3,326,508 | 6/1967 | Born | 248/346.1 |
| 4,124,917 | 11/1978 | Gilliland | 16/42 R |

*Primary Examiner*—John Sipos
*Assistant Examiner*—Carmine Cuda
*Attorney, Agent, or Firm*—John C. Shepard

[57] ABSTRACT

A floor glide for furniture and the like includes a concavo-convex disk having an arcuate convex lower surface, a concave upper surface defining a central cavity, a resilient pad fixed to the disk upper surface within the central cavity below the edge thereof, and adhesive for securing the resilient pad to the bottom of furniture. The glide permits furniture to be moved easily along the surface of the floor.

6 Claims, 3 Drawing Sheets

FURNITURE FLOOR GLIDE

BACKGROUND OF THE INVENTION

1. Technical Field

This invention relates generally to hardware and, more particularly, to a floor glide for furniture.

2. Background Art

In the prior art, coasters for furniture legs are quite common. Coasters are typically glass or rubber disks which are placed under the leg bottom. The coasters usually have a flat bottom so as to rest flat on the floor. The coasters act as a buffer between the legs, which are usually, small and sharp-edged, and the floor and distribute the weight of the leg over a larger area. As a result, the furniture does not scratch or mar the floor when the furniture is moved or leave depressions in the floor when furniture remains in one place over an extended period. However, the coasters found in the prior art do not permit furniture to be moved easily on carpet. The elimination of coasters from furniture legs situated on carpet does not make movement of furniture easier.

SUMMARY OF THE INVENTION

The present invention is directed to overcoming or more of the problems as set forth above.

According to the present invention, a glide providing easier movement of furniture on carpeted and bare floors includes a concavo-convex sheet of material and an adhesive pad carried on the concave upper surface of the sheet within the cavity defined thereby.

In one exemplary embodiment of the invention, a glide includes a concavo-convex disk having an arcuate convex lower surface, a concave upper surface and an outer edge, a resilient pad fixed to the center portion of the sheet with the pad lying below the level of the outer edge and having adhesive for securing the pad to the furniture leg, whereby the furniture leg is placed on the adhesive pad and the convex surface rides on the carpet surface so that the glide does not catch in the carpet pile.

An advantage of the invention is that the contact surface of the glide is smooth with no abrupt angles or edges to "dig" into the carpet or to "plow" when furniture is moved along the floor. The glide disperses the weight of the furniture piece over a large contact area thereby reducing the weight per square inch of contact. This combination of a relatively large, smooth, contoured contact surface reduces carpet wear and the force or thrust required to move furniture across carpet.

In another exemplary embodiment of the invention, a resilient pad is horizontally split and the top and bottom portions are joined only at their opposed centers so that the pad provides a gimbal effect between the leg and the disk allowing the glide to adjustably float on the floor.

In another embodiment of the invention, the disk is formed from two elements, a high-density, low-friction center button and an outer ring carrying the button. The button provides a slick surface and the outer ring, which may be clear, providing the remainder of the arcuate convex surface.

Another advantage of the invention is that the glide can also be used with furniture placed on hard floors, such as wood, linoleum or a no-wax floor.

A further advantage of the invention is that since easy movement is facilitated, stress on furniture legs is minimized when horizontal pressure is applied.

Yet another advantage is that the glide will minimize permanent depressions or holes in the carpet or the underlying padding.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENTS

Best Modes for Carrying Out the Invention

Figure 4:
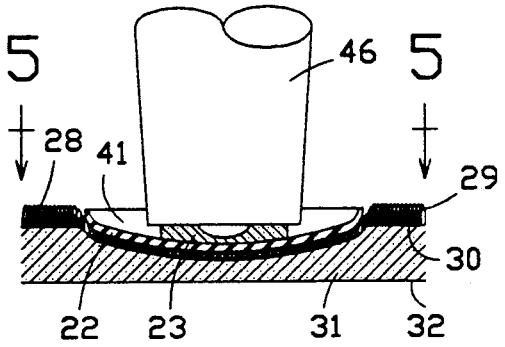
FIG. 4 is a cross-sectional view of the glide of FIG. 2 in use under a furniture leg on a carpeted floor.

Referring to FIG. 1 through 6 of the drawings, a glide, generally designated 20, is comprised of a concavo-convex sheet of material, such as disk 22, and a resilient adhesive pad 23. The glide 20 is used to support a furniture piece 25 on a floor. As shown in FIG. 4, the floor includes a carpet 28 with upraised pile 29 carried on a backing 30 overlying carpet padding 31 placed over the horizontal floor substrate 32.

The disk 22 has a convex lower surface 34, a concave upper surface 35, and a rim surface 36 defined between the peripheral edge 38 of the lower surface 34 and the surrounding outer edge 39 of the upper surface 35. Typically, the disk 22 is approximately 1 to 3 inches in diameter, ¼ to ½ inches high, and defines a concave depression, or central cavity 41, approximately 3/16 to 7/16 inch deep, which has an oval or elliptical vertical cross section. The rim surface 36 faces upwardly and lies in a generally horizontal plane.

The disk 22 is integrally formed or molded from thermoplastic or other suitable material and may also be injection molded or pressure formed. Co-polyester, high-density and ultrahigh density polyethylene, and Teflon R have been found to be very suitable in enabling ease of movement and for use on a variety of floor types. In addition, the material is fairly soft and resilient to minimize the possibility of cracking or breakage. The initial flat thickness of the disk material is 0.080 inches for disks larger than 2 inches in diameter and 0.060 inches for disks smaller than two inches in diameter. This thickness is maintained at the center of the disk during forming, but because of stretching at the edges this thickness may reduced by approximately 40 percent so that the disk edge might be substantially thinner than the disk bottom.

The resilient pad 23 is carried on the upper surface 35 within the cavity 41. The pad 23 includes a main body portion 43, which is fixed, as by adhesive (not shown) to the disk upper surface 35, and has a layer of adhesive (not numbered) on its top surface 44. The body portion 43 may be made of one or more layers of any resilient type material, including plastic foam, felt or rubber or layers of such materials. The pad may be attached to the disk by any suitable means, such as glue or adhesive. As shown herein, the pad 23 is approximately 1 to 2 inches in diameter and is ⅛ to ¼ inch thick so that its top surface 44 lies below the outer edge 39 of the disk 22. In a typical embodiment, the center pad is made of cross-linked polyethylene foam which is approximately ¼ inch thick and has a density of approximately 3 lb/ft$^3$, and has adhesive applied to both flat sides. Typical pad diameters would be 1¼ inches for disks 2¼ or 2¾ inches in diameter and ⅞ inch for disks 1¼ or 1¾ inches in diameter.

The center portion of the disk 22 where the pad 23 is attached may be roughened to provide a non-smooth surface for the adhesive to grip. Usually, this roughening would take place after molding or forming so that the roughening is not transferred through the disk material during shaping to the smooth lower outside bottom surface 34 of the disk. Prior to use, the adhesive on the upper side of the pad may be covered by a removable plastic or waxed backing paper (not shown), which is be peeled away from the pad 23 prior to application.

Figure 1:
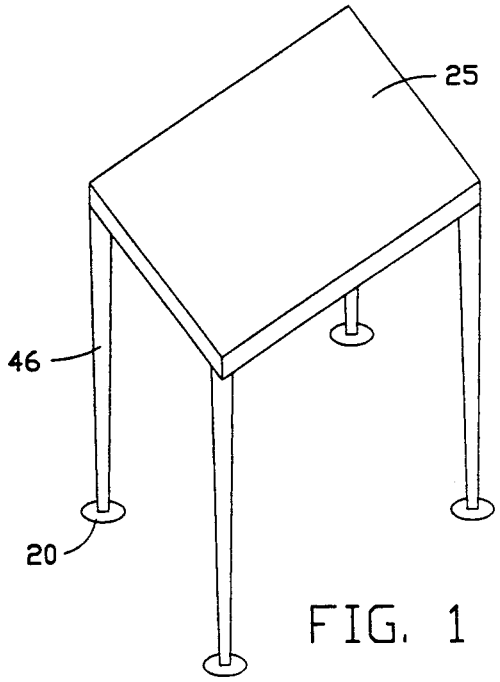
FIG. 1 is a perspective view of a table employing glides constructed in accordance with the present invention.

In use, the glide 20 is attached to the bottom of a furniture leg 46 as seen in FIGS. 1 and 4. Note that the furniture piece 25 does not have to be turned over to install the glide 20. Each furniture leg 46 in turn is simply lifted slightly and the glide 20 is placed under the leg 46 with the adhesive exposed to the leg bottom. When the pad 23 contacts the leg bottom as the leg 46 is lowered, the adhesive bonds the glide 20 to the leg 46. The weight of the furniture piece 25 on the adhesive makes the bond permanent.

The low center of gravity, which is provided by the concavo-convex configuration at the point of contact with the furniture leg 46, cradles the point of contact by placing the shear pressure point above the bonding location. The low center of gravity and the resilient pad 23 help to maintain total contact between the bottom of the furniture leg 46 and adhesive pad 23. When the furniture 25 and glide 20 are moved along the carpet 28 in the direction indicated by the arrow 47 in FIG. 6, the leading curve of the glide 20 bends the pile 29 forward and downwardly from the base of the pile 29. The glide 20 then climbs the pile 29 with the leading edge 49 of the resilient pad 23 being compressed between the lead edge of the leg 46 and the disk 22 and the trailing edge 50 of the pad 23 being permitted to uncompress or expand. This causes the glide 20 to tilt slightly when the furniture piece 25 is moved, thereby creating a natural inclined plane as indicated by dashed line 52. As a result, a mechanical advantage is achieved permitting the glide to ride above the carpet surface. The carpet pile 29 which exits from behind the glide 20 will remain bent over until the glide 20 clears the top end of the pile 29 at which time the pile 29 will snap back up.

The glide disk provides a smooth, continuously arcuate surface and the pad provides a flexible joint thus enabling the glide to travel easily along smooth floors, carpeted floors, or uneven floors. A smaller radius edge 48 is formed to provide rigidity so that the disk does not substantially deform during travel and present a sharp or blunt edge. The glide edge is curved upwardly so that the glide does not dig into the carpet when the carpet fiber hits the glide edge. Rather, the carpet fibers bend along this small radius so that the glide rides over the carpet. In the case of a 2¾ inch diameter disk, the arcuate surface 34 is approximately defined by a 4-inch internal radius and the small radius edge 48 by a 5/32-inch internal radius. By adjusting the small radius arc, a draft angle of 7° may be maintained at the peripheral edge so that disk will release easily from a mold.

Depending on the particular use to which the glide 20 will be put, the size, shape and color of the glide 20 may vary. The sizes and shapes described herein are exemplary of those that might be used with typical tables and chairs.

Figure 9:
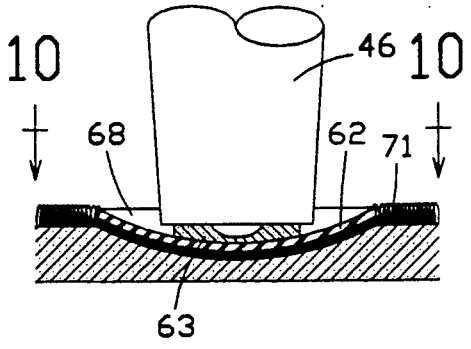
FIG. 9 is a cross-sectional view of the glide of FIG. 7 in use under a furniture leg on a carpeted floor.
Figure 5:
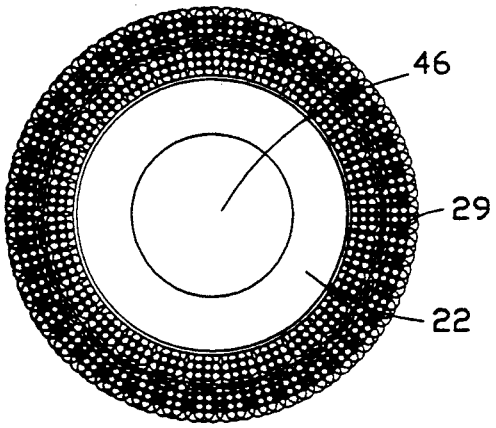
FIG. 5 is a horizontal cross-sectional view taken along line 5—5 of FIG. 4.
Figure 10:
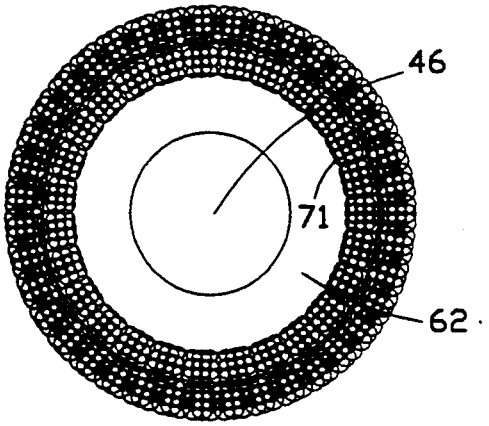
FIG. 10 is a horizontal cross-sectional view taken along line 10—10 of FIG. 9.
Figure 6:
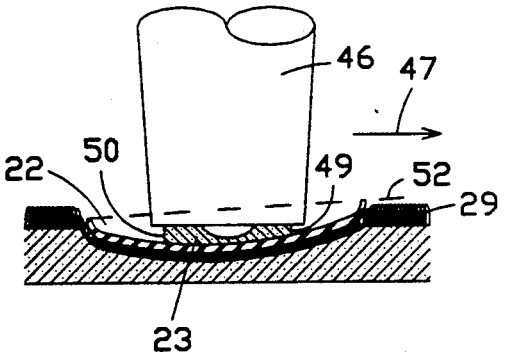
FIG. 6 is a view similar to FIG. 4, but showing the glide moving with the furniture leg along the carpeted floor.

In FIGS. 7 through 10, a second embodiment is shown. Herein, the glide, generally designated 60, includes a disk 62 with a circular vertical cross section and a resilient pad 63. The disk 62 has a convex lower surface 65 and a concave upper surface 66 defining a central cavity 68 and a peripheral rim surface 69 between the respective lower and upper surfaces. The rim surface 69 faces laterally outward and is generally perpendicular to horizontal. In this construction, the carpet pile 71 tends to curl over the glide rim as seen in FIGS. 9 and 10, thereby making the glide 60 less obvious.

Figure 11:
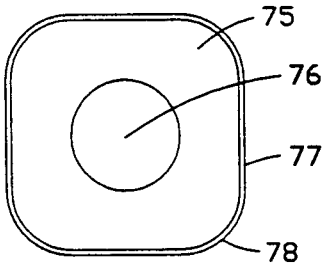
FIG. 11 is a top elevational view of a third embodiment of a glide constructed in accordance with the present invention.
Figure 2:
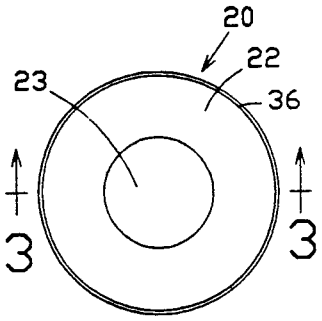
FIG. 2 is a top elevational view of a first embodiment of a glide constructed in accordance with the present invention.
Figure 12:
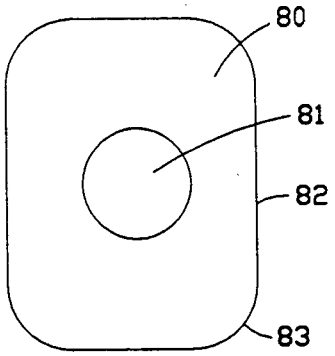
FIG. 12 is a top elevational view of a fourth embodiment of a glide constructed in accordance with the present invention.
Figure 3:
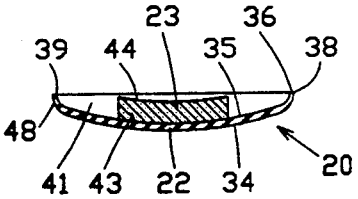
FIG. 3 is a vertical cross-sectional view taken line 3—3 of FIG. 2.
Figure 8:
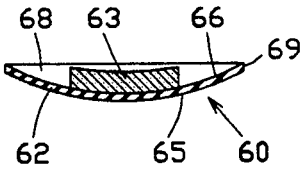
FIG. 8 is a vertical cross-sectional view taken along line 8—8 of FIG. 7.

Note that the disk need not have a circular shape. In FIG. 11, a concavo-convex glide 75, similar in construction to the glide 20, has a resilient adhesive pad 76 and a square configuration with straight sides 77 and rounded corners 78. In FIG. 12, a concavo-convex glide 80, similar to the glide 60, has a resilient adhesive pad 81 and a rectangular configuration with straight sides 82 and rounded corners 83.

Figure 7:
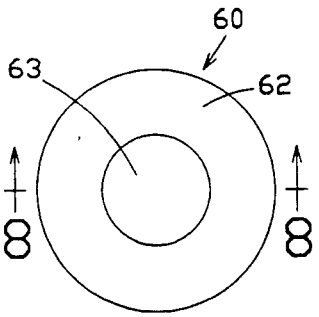
FIG. 7 is a top elevational view of a second embodiment of a glide constructed in accordance with the present invention.

While the sizes and dimensions given above are typical, the actual size of the glide will be determined by the weight of the furniture piece and the dimension and shape of its leg, i.e., larger glides will be used with larger furniture pieces. If the leg is round, the glide might be round; if the leg is square, the glide might be square. In FIGS. 1 and 7, the glide is circular; in FIG. 10, the glide is square with rounded corners; and, in FIG. 11, the glide is rectangular with rounded corners.

Thus, the glide may have a horizontal configuration which is rounded, i.e., circular or oval, or which is box-shaped, i.e., square or rectangular, or any other suitable configuration. Similarly, the pad may be round, oval, square or rectangular, although it has been found that rounded pads will minimize peeling of the adhesive from the disk and the furniture. The glide can be clear or colored. If the user wants a high degree of obscurity, the glide will be made of clear plastic to render the glide transparent. Likewise, on a brown floor, the glide might be brown so that the glide is not easily seen.

Figure 13:
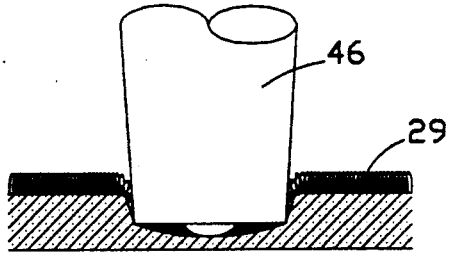
FIG. 13 is a cross-sectional view of a furniture leg resting directly on a carpeted floor without a glide.

In FIG. 13, the furniture leg 46 rests directly on the carpet and digs a hole in the carpet. Because of the sharp edge presented at the bottom of the furniture leg, the furniture must be lifted if it is to be moved since it cannot be moved horizontally directly. With the use of the glide, no such deep hole is made, because the weight of the furniture is distributed over a greater area thereby reducing pressure placed on the carpet. With the smooth surface, the inclined plane and the reduced pressure, the furniture 25 can be moved easily along the carpet 28 without plowing. And at rest, the furniture 25 will not dig into the carpet 28, since the carpet 28 is not crushed straight downward, but simply bent over with less pressure when the furniture 25 is slid horizontally into position. Consequently, the carpet pile 29 is less likely to be left with a deep, permanent depression.

Figure 14:
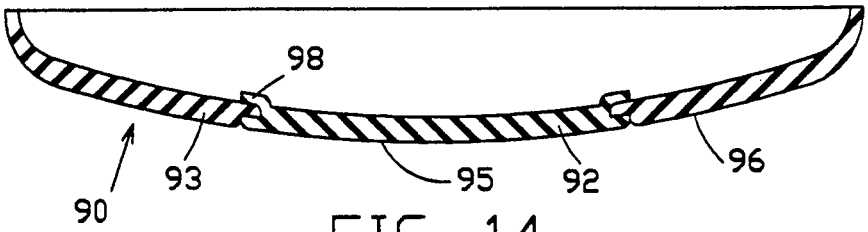
FIG. 14 is an enlarged cross-sectional view of a glide having a center slide button.
Figure 16:
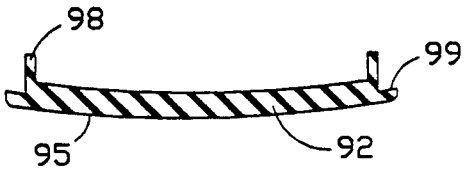
FIG. 16 is an enlarged cross-sectional view of the center slide button taken along line 16—16 of FIG. 15.
Figure 15:
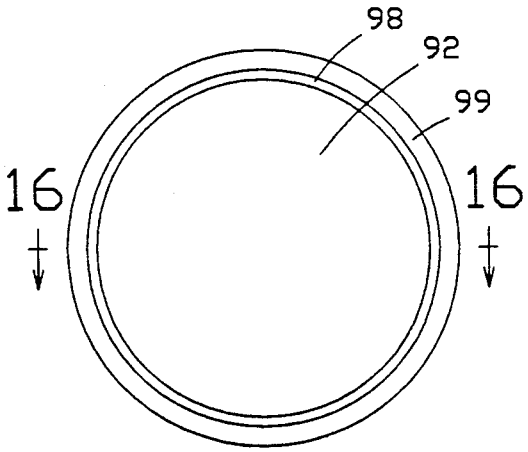
FIG. 15 is an enlarged top elevational view of the center slide button shown in FIG. 14 prior to installation.

In FIGS. 14 through 16, another embodiment of the glide disk, generally designated 90, is shown. The disk 90 is formed from two parts, a center slide button 92 held within an outer carrier, or ring 93. The respective lower arcuate surfaces 95 and 96 of the button 92 and the ring 93, which have the same large radii and relative thickness, together define the smooth arcuate bottom surface of the glide 90. The resilient pad (not shown) is fixed to the top surface of the slide button 92. The slide button 92 may be made of high-density polyethylene and the outer ring 93 may be made of PET polyester or PETG co-polyester. The slide button 92 provides a hard, low friction surface and the outer ring 93 provided as a clear transparent carrier, since high-density polyethylene may not be manufactured as a clear material.

In FIGS. 15 and 16, the slide button 92 is seen to include an upwardly extending annular flange or tab 98 which is turned over unto the top surface of the ring 93 as seen in FIG. 14 during assembly to hold it in place. The slide button 92 includes a recessed annular shoulder 99 which abuts a corresponding shoulder (not numbered) defined in the central opening of the ring 93. When the shoulders are in proper alignment, the tab 98 is rolled over to fix the slide button 92 in place.

Figure 17:
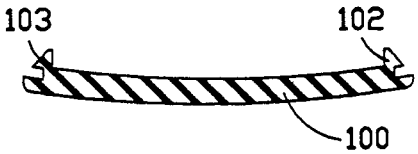
FIG. 17 is an enlarged cross-sectional view of an alternative embodiment of the center slide button.

In FIG. 17, another type of slide button 100 has a flange tab 102 with a camming surface 103 so that the tab 102 will flex radially inward when the slide button 100 is inserted into the outer ring during assembly. After the camming surface 103 has passed through the opening, the tab 102 snaps outward so that the lower edge mates with the top surface of the ring to hold the slide button 100 in place. The flange tab 102 may be formed in arced sections so that the tabs may be flexed easily.

Figure 18:
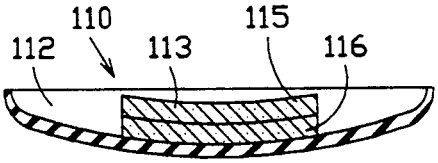
FIG. 18 is a cross-sectional view of the glide of FIG. 1, but employing an alternative resilient pad construction; and, FIG. 19 is a cross-sectional view of the resilient pad of FIG. 18, but having the pads moved apart to show the center attachment.
Figure 19:
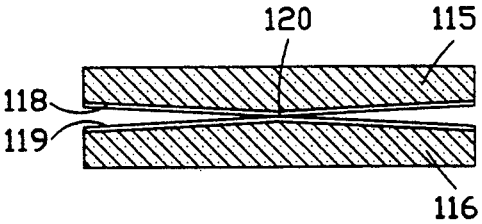

In FIGS. 18 and 19, another embodiment of the glide is shown. Herein, the glide 110 includes a disk 112 and a resilient pad 113 is horizontally split into upper and lower portions 115 and 116. The upper and lower pad sections 115 and 116 are joined at their centers so that the pad 113 provides a "rocking" or gimbal effect between the leg and the disk 112 allowing the glide 110 to adjustably float on the floor. The pad portions 115 and 116 may be made of plastic foam with the opposed surfaces covered with tightly-woven cloth or canvas as indicated at 118 and 119. The opposed cloth surfaces are then sewn, glued, or otherwise suitably attached at their center. The pad portions 115 and 116 have been moved apart in FIG. 19 to show that the pads when deformed are attached at 120. By such a construction, the pad portions may flex in any direction relative to the other so that the disk may pivot easily as it is moved across a floor surface which may be uneven. As a result, any stress placed on the glide is taken up by the cloth so that any stress on the foam pads and the attaching adhesive is relieved. It can thus be seen that the flexing of the center pad in this manner allows angular movement of the glide disk itself.

Industrial Applicability

From the foregoing, it should be apparent that the glides described herein are simple and inexpensive and provide a convenient and effective means for moving and locating furniture on flooring, such as carpet.

Other aspects, objects and advantages of this invention can be obtained from a study of the drawings, the disclosure and the appended claims.

What is claimed is:

1. A glide for supporting furniture and appliances on a substantially horizontal floor surface comprising:

a concavo-convex disk having an arcuate convex lower surface with a peripheral edge and a concave upper surface defining a central cavity with a surrounding outer edge, said disk comprising a low-friction slide button defining the center portion of the disk lower surface and an outer carrier holding said button and defining the remainder of the disk lower surface, a resilient pad fixed to the disk upper surface within said central cavity and having a top surface facing upwardly, and adhesive means for securing said top surface of the resilient pad to the bottom of furniture, whereby the glide is positioned between the supported furniture and the floor with said lower surface riding on the floor surface so that the glide moves easily along the floor.

2. A glide for supporting furniture and appliances on a substantially horizontal floor surface comprising:

a concavo-convex disk having an arcuate convex lower surface with a peripheral edge and a concave upper surface defining a central cavity with a surrounding outer edge, a resilient pad fixed to the disk upper surface within said central cavity and having a top surface facing upwardly, and adhesive means for securing said top surface of the resilient pad to the bottom of furniture, said resilient pad having upper and lower portions, the upper surface of said upper pad portion carrying said adhesive means and the lower surface of said lower pad portion being fixed to the disk upper surface, and the opposed surfaces of said pad portions being joined at their respective centers to provide a flexible hinge between said pad portions, whereby the glide is positioned between the supported furniture and the floor with said lower surface riding on the floor surface so that the glide moves easily along the floor.

3. A glide for supporting furniture and appliances on a substantially horizontal floor surface comprising:

a concavo-convex disk of substantially uniform thickness along the bottom thereof, said disk having a convex lower surface with a peripheral edge and a concave upper surface defining a central cavity with a surrounding outer edge, said lower surface being continuously arcuate over its entire extent, said peripheral edge of said lower surface lying below said outer edge of said upper surface to define a rim therebetween substantially perpendicular to horizontal, a resilient pad fixed to the disk upper surface within said central cavity, and adhesive means for securing the top surface of the resilient pad to the bottom of furniture, whereby the glide is positioned between the supported furniture and the floor with the lower surface of the glide sliding along the surface of the floor to facilitate movement of the furniture along the floor.

4. A glide for supporting furniture and appliances on a floor surface comprising:

a concavo-convex disk having an arcuate convex lower surface and a concave upper surface defining a central cavity, said disk having a low-friction slide button defining the center portion of the disk lower surface and an outer carrier holding said button and defining the remainder of the disk lower surface, a resilient pad fixed to the disk upper surface within said central cavity, adhesive means for securing said top surface of the resilient pad to the bottom of furniture, whereby the glide is positioned between the supported furniture and the floor with said lower surface riding on the floor surface so that it moves easily thereon.

5. A glide for supporting furniture and appliances on a floor surface comprising:

a concavo-convex disk having an arcuate convex lower surface and a concave upper surface defining a central cavity, a resilient pad fixed to the disk upper surface within said central cavity, said resilient pad having upper and lower portions with the lower surface of said lower pad portion being fixed to the disk upper surface and the opposed surfaces of said pad portions being joined at their respective centers to provide a flexible hinge between said pad portions, adhesive means carried on the upper surface of said upper pad portion for securing the top surface of the resilient pad to the bottom of furniture, whereby the glide is positioned between the supported furniture and the floor with said lower surface riding on the floor surface so that the glide may pivot as it moves along the floor surface.

6. The glide of claim 3 further including woven material fixed to each of the respective opposed surfaces of said pad portions, said woven material being joined at their respective centers to join said pad portions together.

* * * * *